US005517832A

United States Patent [19]

Kristensen

[11] Patent Number: 5,517,832

[45] Date of Patent: May 21, 1996

[54] PANTY BRIEF WITH WIDE LEG OPENINGS

[75] Inventor: Johannes N. Kristensen, Ikast, Denmark

[73] Assignees: Tytex A/S, Ikast, Denmark; Mölnlycke AB, Mölnlycke, Sweden

[21] Appl. No.: 335,761

[22] PCT Filed: May 13, 1993

[86] PCT No.: PCT/DK93/00162

§ 371 Date: Apr. 11, 1995

§ 102(e) Date: Apr. 11, 1995

[87] PCT Pub. No.: WO93/22999

PCT Pub. Date: Nov. 25, 1993

[30] Foreign Application Priority Data

May 14, 1992 [DK] Denmark ..... 0643/92

[51] Int. Cl.[6] ..... A61F 13/72; D04B 21/18; A41B 9/00

[52] U.S. Cl. ..... 66/177; 66/172 R; 66/175; 2/406

[58] Field of Search ..... 66/171, 172 R, 66/175, 177, 202; 2/406, 407

[56] References Cited

U.S. PATENT DOCUMENTS

| | | | |
|---|---|---|---|
| 2,074,119 | 3/1937 | Boysen et al. | 66/175 |
| 2,450,168 | 9/1948 | Schwartz | 2/406 |
| 3,048,176 | 8/1962 | De Woskin | 2/406 |
| 3,656,324 | 4/1972 | Jackson . | |
| 4,586,195 | 5/1986 | Birring . | |
| 4,624,115 | 11/1986 | Safrit et al. | 66/172 R |
| 4,722,202 | 2/1988 | Imboden | 2/406 X |

FOREIGN PATENT DOCUMENTS

| | | | |
|---|---|---|---|
| 734638 | 5/1966 | Canada | 66/171 |
| 2093080 | 8/1982 | United Kingdom . | |
| 2121840 | 1/1984 | United Kingdom . | |

*Primary Examiner*—John J. Calvert
*Attorney, Agent, or Firm*—Watson Cole Stevens Davis

[57] ABSTRACT

A panty brief is made by flat knitting a front piece (1) and a back piece (1'), leg openings (8,9) being formed at a marginal edge zone (6) at the bottom of the panty brief. The marginal bottom edge zones (6) are partially made of soluble yarn (8) for forming larger stitches (19,20) and thereby a looser structure in the panty brief after dissolution of the yarn.

13 Claims, 5 Drawing Sheets

PANTY BRIEF WITH WIDE LEG OPENINGS

BACKGROUND OF THE INVENTION

The present invention relates to panty briefs formed by a flat knitted, substantially rectangular front piece and back piece, which are made separately, and which by interknitting are connected along marginal edge zones in the sides of the panty briefs for forming side seams, and along a part of the bottom of the panty briefs for forming a crotch region separating two non-connected parts of the marginal edge zones at the bottom of the panty briefs for forming leg openings, the panty briefs being made with elastic threads, which generally extend from one side to the other of the front and back pieces for providing a circumferentially elastic contraction in the panty briefs.

THE PRIOR ART

It is known to make panty briefs by knitting with different forms in order to obtain the best possible fit without a need for after-fashioning of the panty briefs. Even though several proposals have been made, the panty briefs for fixation of a napkin will normally require a circumferential elasticity so that an elasticity occurs at the leg-bands formed at the marginal edge zone at the bottom of the panty briefs; however, the elasticity at the leg-bands may be irritating for the user due to a local compressive press.

WO 91/19845 describes panty briefs with front and back pieces connected along other parts of marginal edge zones. Leg openings are provided opposite each other at a lower non-connected part of the marginal edge zones. In order to obtain a crotch region with some elasticity, some embodiments may have a zone having a looser knitting. However, the knitting is always provided as closed stitches and this is a drawback because it is necessary to control the knitting process very accurately and because the knitting must be different depending on which part of the panty briefs is being knitted.

Panty briefs according to the present invention may be considered as a further development of panty briefs which are described in the U.S. Pat. No. 3,656,324, the content of which is hereby incorporated by reference. Thus materials, knitting types, stitch size, embodiments, etc., which are described in this United States Patent may also be used when making the panty briefs according to the present invention.

It is the object of the present invention to remedy the drawbacks of the known panty briefs, especially for fixation of napkins, by providing panty briefs of the above-mentioned type, which may be made by machines and in endless lengths without a need for after-fashioning and which are provided with leg openings, which do not cause a local compressive press on a user.

SUMMARY OF THE INVENTION

According to the present invention this is obtained by panty briefs, characterized in that, in the finished panty briefs, only part of the stitches being formed in the front and back pieces of the panty briefs in a marginal edge zone at the bottom of the panty briefs when knitting the panty briefs are closed.

Finished panty briefs in which only part of the stitches in the marginal edge zone are closed will appear with a loose structure. Thus, the remaining part of the stitches, which during or after the making of the panty briefs are opened, will give rise to a surplus of yarn between the remaining stitches. In practice, this means that the stitches formed in the finished panty briefs will be substantially larger, thus resulting in the looser structure. Stated in a popular way, if only half of the stitches in the finished panty briefs are closed, it is possible to make the stitches twice the size of those of traditional flat knitted panty briefs in which all of the stitches are closed.

As the marginal edge zone, which is located in the vicinity of the leg openings at the bottom of the panty briefs has a looser structure, the finished panty briefs acquire a very great width in the leg openings, which will not give rise to the local compressive press which traditional leg-bands may cause.

According to the invention panty briefs will not solely be suitable as normal panty briefs, but will also be especially suitable as panty briefs for fixation of a napkin. Thus, the looser structure obtained in the marginal edge zone at the bottom of the panty briefs will not solely give the leg openings a greater width, but will also form a looser structure in the crotch region between the leg openings. Thus, the panty briefs will be suitable for containing and fixing a napkin in the crotch region as a marketed banana-shape, and a great width appears in the region between the leg openings.

Panty briefs according to a preferred embodiment, and after the threads are dissolved either by washing or by other treatments, will have an opening of the stitches so that only the remaining part of the stitches are closed in finished panty briefs. Thereby, very loose stitches will appear in the marginal edge zone delimiting the leg openings. In case the soluble yarn is a water-soluble yarn, it will advantageously be possible to make the panty briefs ready for use after they have been subjected to a per se well-known fixation process after they have left a knitting machine.

Panty briefs according to another preferred embodiment will be provided with the loose structure and be ready for use immediately after having left a knitting machine. Thus, these panty briefs will not require any treatment, except for the well-known fixation process. This embodiment for panty briefs may advantageously be made by using knitting machines which are able to work with compound needles, which make it possible that the stitches are optionally closed or opened. This is simply effected by a separate controlling of the guide bar for the needles which are used for making the marginal edge zone. Furthermore, this embodiment of the panty briefs is advantageous as it may be made at lower costs, seeing that neither use of soluble yarn nor an after-treatment for dissolution of such yarn is required.

DESCRIPTION OF THE DRAWINGS

The invention will now be further explained with reference to the accompanying drawing, wherein.

DETAILED DESCRIPTION OF THE PREFERRED EMBODIMENTS

Figure 1:
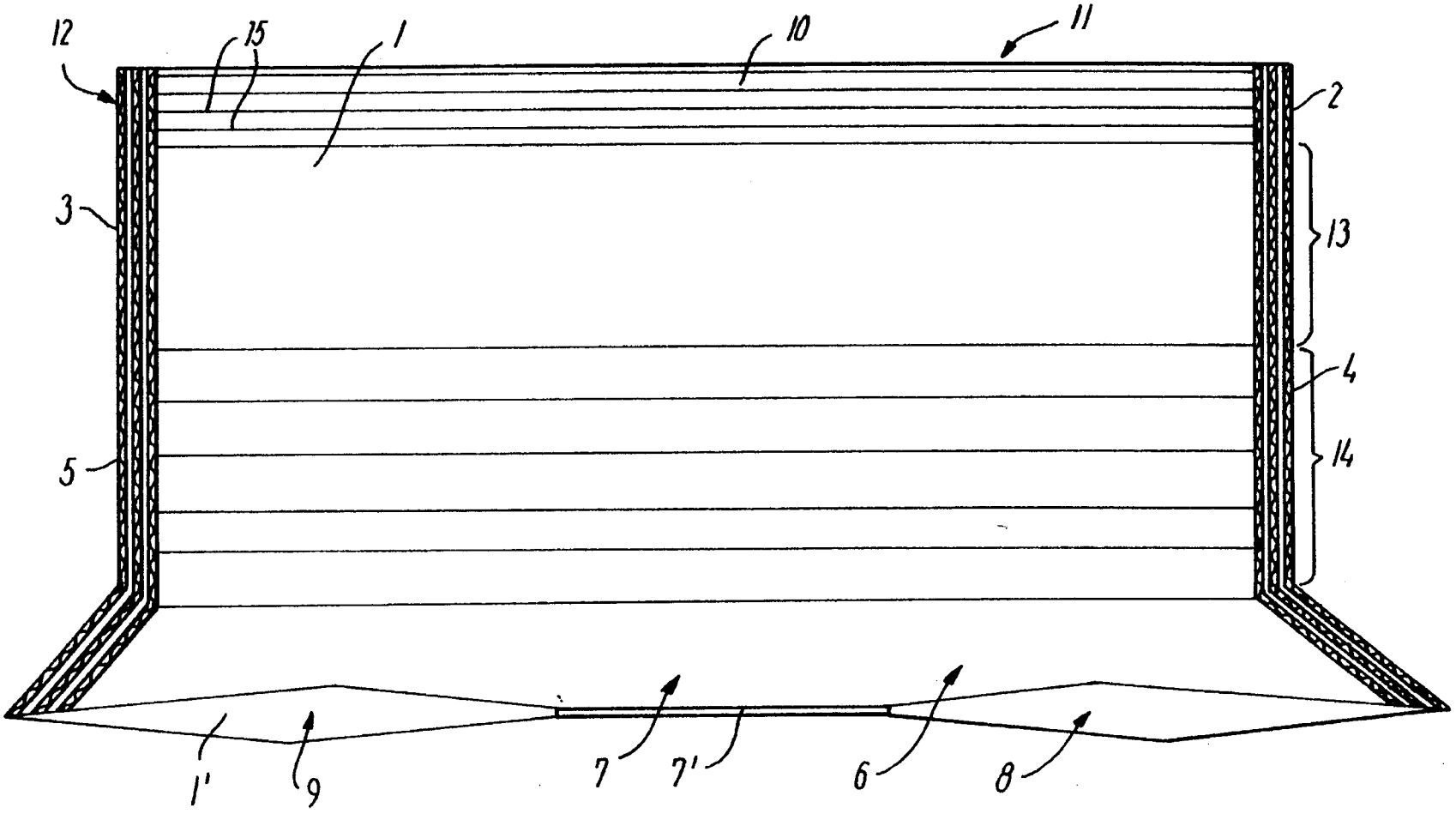
FIG. 1 shows an embodiment of panty briefs according to the invention.

FIG. 1 shows a substantially rectangular front piece 1 of panty briefs according to the invention. The rectangular front piece 1 is placed superposed on a substantially corresponding back piece 1'. The back piece 1' may have a size identical to that of the front piece 1 or may be slightly larger as shown in FIG. 1, in order to make the panty briefs more anatomically correct. Along the marginal edge zones 2,3 in the sides of the panty briefs the front piece 1 and the back piece 1' are interknitted for forming side seams 4,5. Furthermore, the front piece 1 and the back piece 1' are interknitted along a part of the marginal edge zones 6 at the bottom of the panty briefs for forming a crotch region 7 comprising a seam 7'. The crotch region 7 separates two non-connected parts of the marginal edge zones 6 at the bottom of the panty briefs for forming leg openings 8,9.

The front piece 1 and the back piece 1' are made in endless lengths on a conventional knitting machine, e.g. a Raschel knitting machine, in which a first needle bed is used for making the front piece 1, and a second needle bed is used for making the back piece 1'. The endless lengths are severed transversely for forming separate panty briefs. The severing takes place in severing zones (not shown).

The front piece 1 and the back piece 1' are not connected at the marginal edge zones 10, and a waist opening 11 appears between these. The waist opening 11 is surrounded by a waistband 12 which, in a per se well-known way, is formed by means of elastic threads 15, which are interknitted in the marginal edge zone 10.

The panty briefs are made with elastic threads, which generally extend between the marginal edge zones 2,3 on the front piece 1 and the back piece 1'. Consequently, an elastic circumferential contraction is provided in the panty briefs. This ensures that the panty briefs are secured firmly on the user. These threads completely or partially form the basic web in the front piece and the back piece. In the panty briefs shown a stocking stitched region 13 is located under the waistband 12, followed by a more net-like region 14. Next to the net-like region 14 the marginal edge zone 6 is provided at the bottom of the panty briefs.

It is at the knitting in the marginal edge zone 6 the panty briefs according to the present invention differ from the known panty briefs. In the panty briefs shown in FIG. 1, it clearly appears that the marginal edge zone 6 has a greater width than the regions 12–14. This is due to the fact that during manufacturing this part of the panty briefs is partially made from soluble yarn (a further explanation follows).

Consequently, a looser structure is obtained in the finished panty briefs after the dissolution of the yarn. Consequently, it will be possible to make the leg openings 8,9 with such a width and looseness, that localized compressive press does not occur on the thigh of the user, even if the panty briefs are provided with such a circumferential elasticity that it is secured firmly and tightly around the torso of the user.

Figure 2:
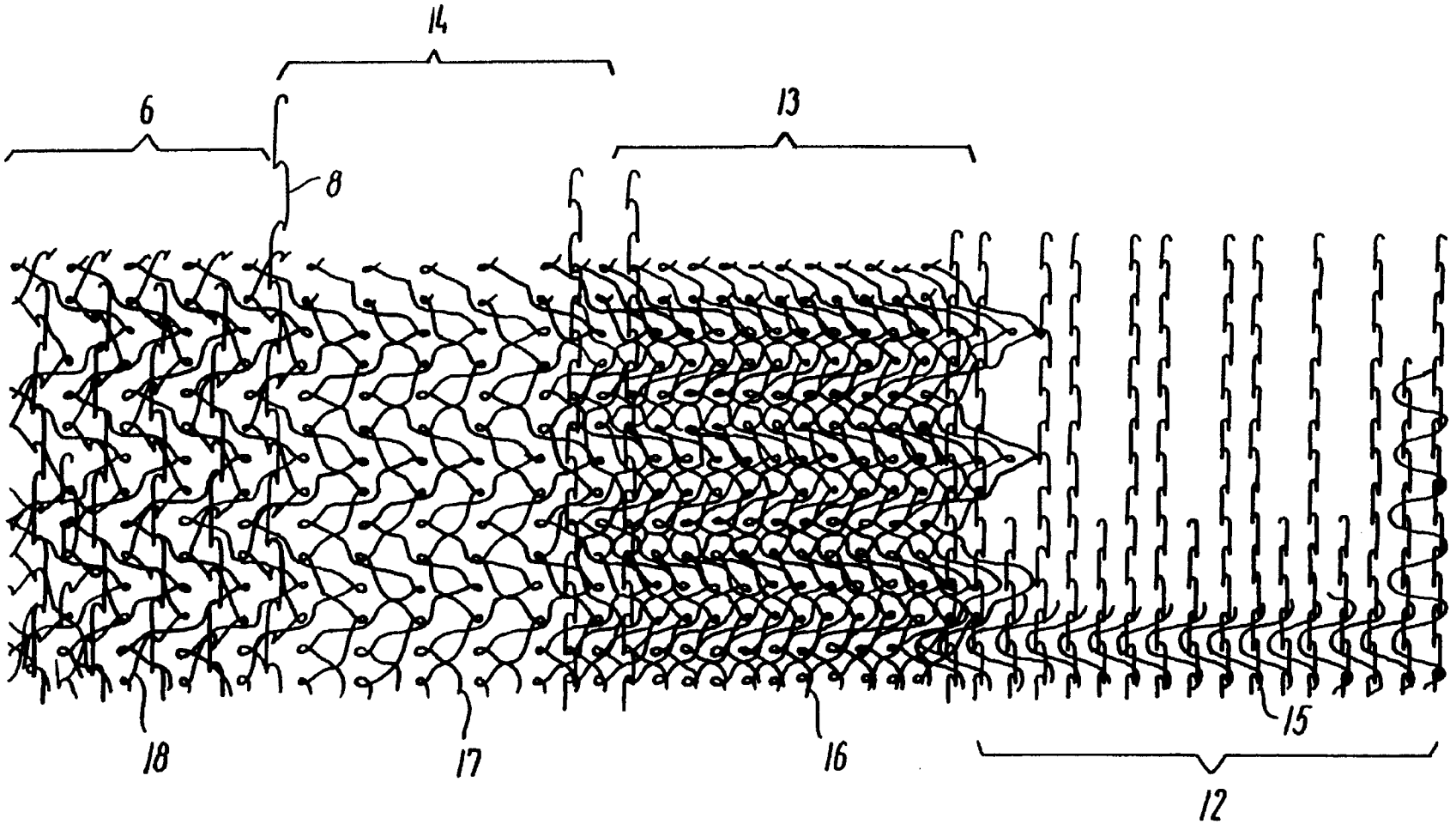
FIG. 2 shows a partial representation of a knitting pattern for the panty briefs shown in FIG. 1, FIGS. 3–5 show enlarged views illustrating the forming of stitches in panty briefs according to the present invention.

FIG. 2 shows a knitting pattern for the panty briefs shown in FIG. 1. It is noted that the extension of the individual regions 6,12,13 and 14 may vary, and that the knitting pattern only illustrates the knitting in each of the regions of the front piece 1 and the back piece 1'. In the waistband region elastic threads 15 are interknitted in a great number in order to form the very elastic waistband. In the stocking stitched region 13 a smooth and tight knitting is obtained, and preferably wound elastan yarn 16 is used. Alternatively, non-wound yarn may be used, and the yarn may be made of nylon or polyester. The region 14 is knitted with an open net-like structure. In the region 14 every second needle is used in order to obtain the open knitting, and the yarn used may comprise cotton yarn 17. It is noted that it is also possible to use the wound elastan or other yarn in this region.

In the region 6 the same knitting is used in principle as in the region 14. However, in the region 6 needles are used for interknitting a soluble yarn 8, which e.g. may be a solvron yarn. As the stitches in the region 6 are knitted with stitches extending over several juxtaposed needles, it is possible to interknit the soluble yarn 18 on an intermediate row of needles. In the embodiment shown yarn 18 is interknitted in the region 6, which yarn may be nylon yarn for forming the net-knit.

Figure 4:
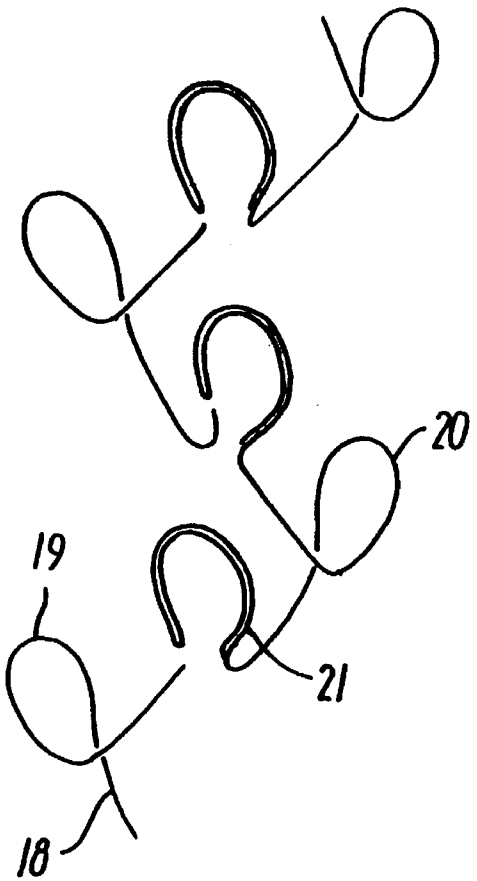
Figure 3:
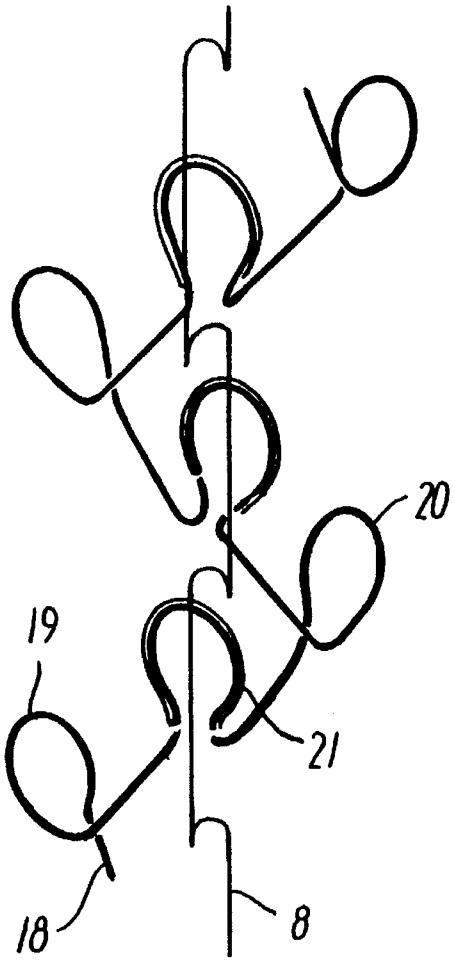

In the embodiment shown stitches are formed on three juxtaposed needles. This clearly appears from FIGS. 3–5. In FIG. 3 it is seen that the yarn 18 forms stitches 19,20,21 on three juxtaposed needles. On the interposed needle the soluble yarn 8 is used. The outermost stitches 19 and 20 are closed stitches, while the interposed stitches 21 are closed by means of the soluble yarn 8.

Figure 5:
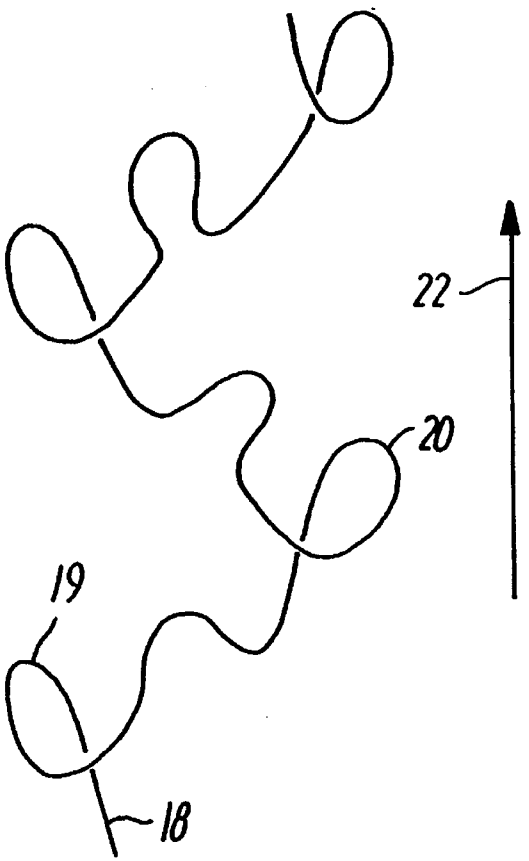

Thus, after the yarn 8 is dissolved (see FIG. 4), it will be possible to open the stitches 21. In this state the stitches 19,20, as seen in FIG. 5, appear larger and with a looser structure. Consequently, it will be possible to obtain a treater extension in the knitting direction 22. This is used for obtaining the desired, looser marginal edge zone 6 in the immediate vicinity of the leg openings 8,9 (see FIG. 1).

It is noted that it is possible to make the panty briefs in other embodiments than the embodiment shown in FIG. 1. Thus, it will be possible to make the panty briefs according to one of the two alternative embodiments, which are shown at the left and right side in FIG. 6.

At the left side panty briefs are shown having elastic threads 23 extending obliquely from the crotch region 7 of the panty briefs upwards towards the side edge 3 of the panty briefs in order to obtain a better compressive effect along the side edges 26 of a napkin 27, when the panty briefs according to the invention are to be used as panty briefs for fixation of a napkin.

Figure 6:
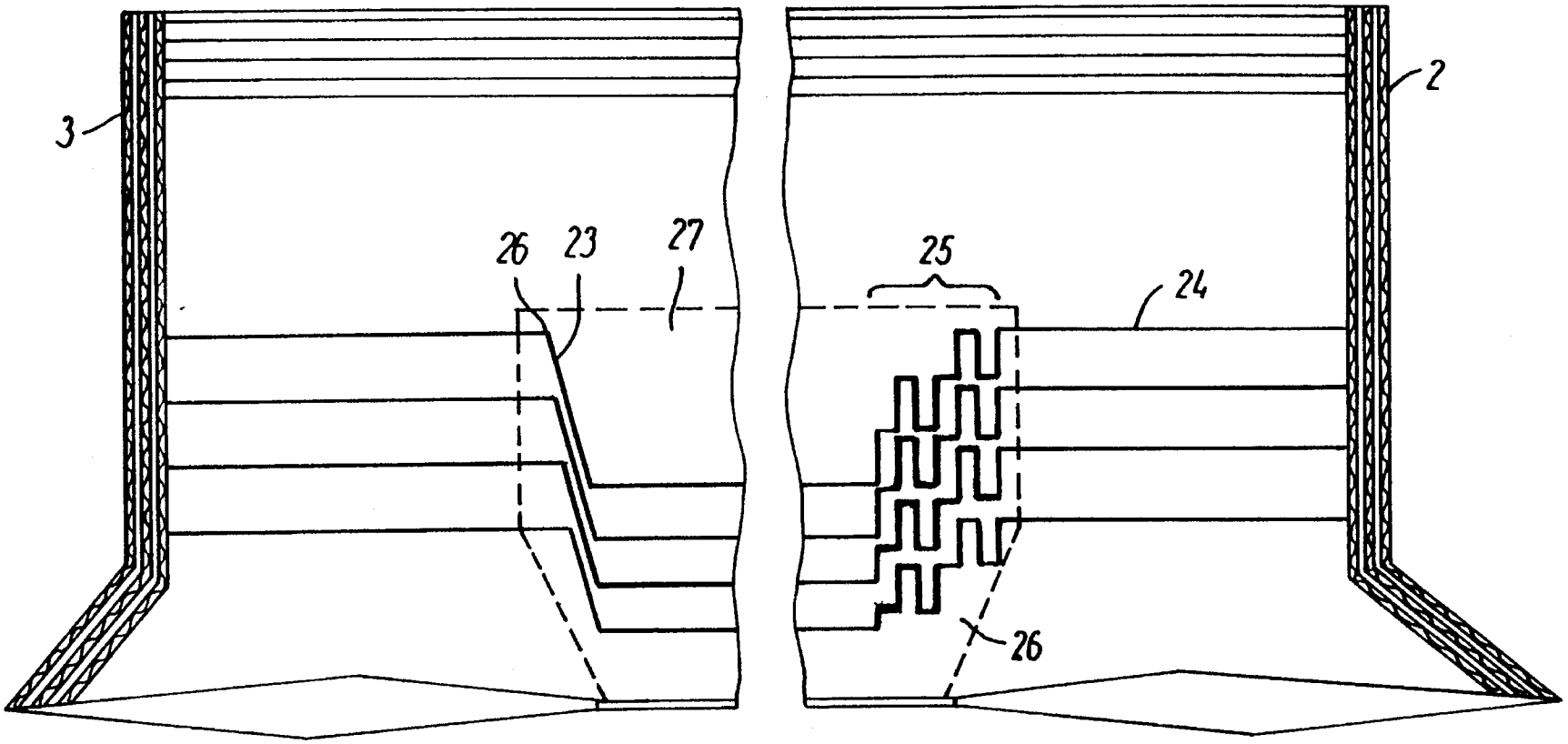
FIG. 6 shows a second embodiment and a third embodiment of panty briefs according to the invention at the right and left side respectively.

The right side of FIG. 6 shows an alternative way of placing elastic threads 24 generally extending from the crotch region 7 obliquely outwards towards the side edge 2 of the panty briefs. In this region 25, in which the threads extend with a substantially oblique orientation, the threads are interknitted in a meander-like pattern. Because of this special interknitting of the elastic threads 24, not only a compressive effect is obtained along the side edges 26 of the napkin 27, but also a transverse elasticity in the panty briefs is obtained so that this is secured firmly around the torso of the user.

However, the panty briefs will also be useful as panty briefs for fixation of a napkin without interknitting of such elastic threads 23,24 extending obliquely.

It will also be possible to interknit the soluble yarn with greater or lesser intensity. Instead of interknitting every second needle, two out of three needles or three out of four needles may be threaded with soluble yarn so that only every third or fourth needle is threaded with unsoluble yarn for obtaining a looser structure in the marginal edge zone 6 of the finished panty briefs. Thus, it will also be possible to interknit the yarn in every third or every fourth needle in order to obtain a less open structure. It will also be possible to let the soluble yarn be a part of the forming of several provisionally closed stitches for forming a structure having a greater openness after the dissolution of the yarn.

Figure 7:
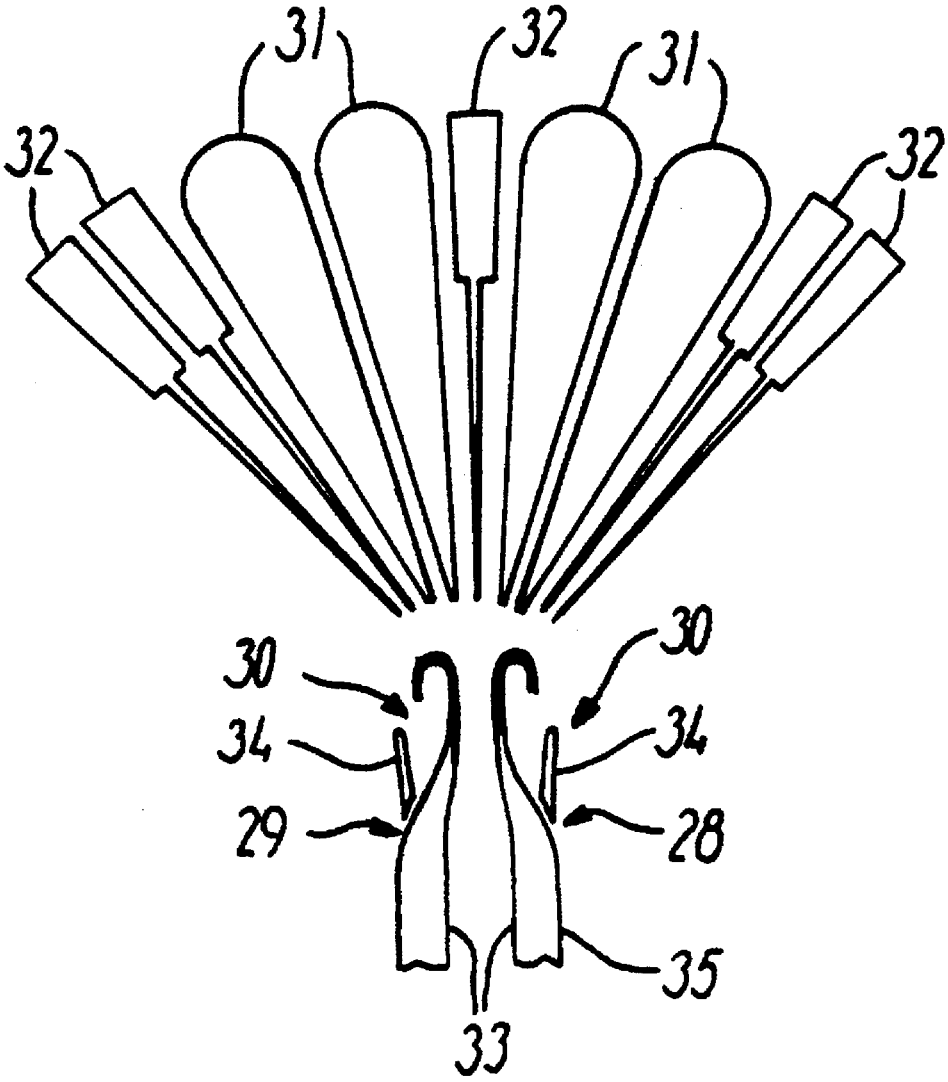
FIG. 7 illustrates a principle for a needle arrangement of a knitting machine for use in making panty briefs according to the invention.

In FIG. 7 the elements are shown schematically which are part of a knitting machine which may be used for making panty briefs according to the invention. The knitting machine is a Raschel-machine with two needle beds 28,29. In the needle beds 28,29 compound needles 30 are provided. In the embodiment shown the machine is provided with four basic guide bars 31 and a number of pattern guide bars 32. It is noted that the five guide bars 32 are shown as a practical example as twelve are needed for the specific product.

As a person skilled in the art will know how such a knitting machine works, it is only to be mentioned that each of the compound needles 30 is made from two separate elements, i.e. a needle element 33 and a closing element 34, which may be shifted in a forward and backward motion in a track, which is left open in the stem 35 of the needle element 33. Thus, the closing and opening of the stitches are decided by the way in which the closing element 34 is controlled in relation to the needle element 33 in each of the compound needles 30, which are placed in the needle beds 28,29. Seeing that knitting machines are only threaded on a part of the needles, preferably every second needle, it will be possible on the interposed empty needles to form a stitch, which is opened (as shown in FIG. 2). Thus, during the knitting it will be possible to obtain the same effect illustrated in FIGS. 3,4 and 5, without the necessity of using a soluble yarn. In practice, it is also possible to thread every third or every fourth needle, in order to obtain an even looser structure.

Thus, it is possible to make the front pieces and the back pieces, in which the marginal edge zones in the bottom of the panty briefs are made with a very loose structure, only by threading a part of the needles, which are used for making the stitches in the marginal edge zone.

I claim:

1. A method of forming panty briefs having a loose bottom structure comprising the steps of:

providing flat knitted, substantially rectangular front and rear pieces which each provides opposite marginal side edge zones, a marginal top edge zone and a marginal bottom edge zone, each front and rear piece including flat knitted pieces formed of stitches including elastic yarns that extend generally between said opposite marginal side edge zones thereof, and some yarns being removable, connecting side edges of said front and rear pieces and connecting bottom edges thereof to form a crotch region between non-connected regions forming leg openings, and removing said removable yarns.

2. A method of forming panty briefs according to claim 1, wherein part of a yarn used for forming stitches in said marginal bottom edge zones of said front and back pieces is soluble yarn.

3. Panty briefs according to claim 2, wherein the soluble yarn is water-soluble yarn.

4. Panty briefs according to claim 2, wherein the soluble yarn is steam-soluble yarn.

5. Panty briefs according to claim 1, wherein the removable yarn constitutes less than 10% by weight of the yarn in the marginal edge zone of the panty briefs.

6. Panty briefs according to claim 5, wherein the removable yarn constitutes between 0.5 and 2% by weight of the yarn.

7. Panty briefs according to claim 1, wherein the amount of the removable yarn per area unit gradually increases towards a bottom portion of the panty briefs forming a looser structure nearest the bottom of the panty briefs.

8. Panty briefs according to claim 1, wherein a width of the marginal edge zone having a loose structure is of between 10 and 25 mm in an unstretched state.

9. Panty briefs according to claim 8, wherein the width of the marginal edge zone is between 15 and 25 mm in an unstretched state.

10. Panty briefs according to claim 1, wherein the elastic threads in the bottom of the panty briefs are made up of wound yarn forming stitches together with the removable yarn.

11. A method of forming panty briefs having a loose bottom structure comprising the steps of:

providing flat knitted, substantially rectangular front and rear pieces which each provides opposite marginal side edge zones, a marginal top edge zone and a marginal bottom edge zone, each front and rear piece including flat knitted pieces formed of stitches including elastic yarns that extend generally between said opposite marginal side edge zones thereof, only some of the stitches in the marginal bottom edge zones being closed, and connecting side edges of said front and rear pieces and connecting bottom edges thereof to form a crotch region between non-connected regions forming leg openings.

12. A method of forming panty briefs according to claim 11, comprising the further step of knitting using compound needles and controlling the front and rear pieces, which needles in said marginal bottom edge zones by a separate guide bar which threads some of the needles only so that some of the stitches in said marginal bottom zones are opened.

13. Panty brief comprising a flat knitted, substantially rectangular front piece having opposite marginal side edge zones, a marginal top edge zone and a marginal bottom edge zone, said front piece formed of stitches including elastic yarns extending generally between said marginal side edge zones, only a portion of the stitches used in the marginal bottom edge zone being closed; a flat knitted, substantially rectangular back piece having opposite marginal side edge zones, a marginal top edge zone and a marginal bottom edge zone, said back piece formed of stitches including elastic yarns extending generally between said marginal side edge zones, only a portion of the stitches used in the marginal bottom edge zone being closed; and means for connecting corresponding sides of said front and back pieces and for connecting corresponding bottoms of said front and back pieces to form a crotch region between two non-connected leg opening areas; said panty briefs having a lose structure at a bottom thereof due to only a portion of said stitches in said marginal zones of said front and back pieces being closed.

* * * * *